US007913474B2

(12) United States Patent
Aquarius

(10) Patent No.: US 7,913,474 B2
(45) Date of Patent: Mar. 29, 2011

(54) APPARATUS FOR INFLATING TUBE FILM FOR MANUFACTURING PACKAGING MATERIAL, AND A METHOD FOR INFLATING TUBE FILM WITH SUCH APPARATUS

(75) Inventor: Pieter Theodorus Joseph Aquarius, Stramproy (NL)

(73) Assignee: Ideepak Holding B.V., Stramproy (NL)

( * ) Notice: Subject to any disclaimer, the term of this patent is extended or adjusted under 35 U.S.C. 154(b) by 0 days.

(21) Appl. No.: 12/201,901

(22) Filed: Aug. 29, 2008

(65) Prior Publication Data

US 2009/0057962 A1 Mar. 5, 2009

(30) Foreign Application Priority Data

Aug. 29, 2007 (NL) ..... 1034305

(51) Int. Cl.
*B65B 31/00* (2006.01)

(52) U.S. Cl. ..... 53/403; 53/79; 493/314; 493/967

(58) Field of Classification Search ..... 53/432, 53/433, 434, 403, 79, 510, 511, 512; 493/967, 493/239, 313, 314
See application file for complete search history.

(56) References Cited

U.S. PATENT DOCUMENTS 3,575,757 A * 4/1971 Smith ..... 156/147
3,703,430 A * 11/1972 Rich ..... 156/497
3,817,803 A * 6/1974 Horsky ..... 156/85
4,017,351 A * 4/1977 Larson et al. ..... 156/494
4,049,854 A * 9/1977 Casey et al. ..... 428/72
4,384,442 A * 5/1983 Pendleton ..... 53/554
5,581,983 A * 12/1996 Murakami ..... 53/512
5,660,662 A * 8/1997 Testone ..... 156/145
5,873,215 A * 2/1999 Aquarius et al. ..... 53/403
5,937,614 A * 8/1999 Watkins et al. ..... 53/79
5,942,076 A * 8/1999 Salerno et al. ..... 156/359
6,289,649 B1 * 9/2001 Cherfane ..... 53/284.7
7,165,375 B2 * 1/2007 O'Dowd ..... 53/96
7,429,304 B2 * 9/2008 McNamara et al. ..... 156/145

(Continued)

FOREIGN PATENT DOCUMENTS

GB 2 384 459 A 7/2003

(Continued)

OTHER PUBLICATIONS

European Search Report dated Dec. 2, 2008 for EP 08 16 3344.

*Primary Examiner* — Paul R Durand
(74) *Attorney, Agent, or Firm* — Leydig, Voit & Mayer Ltd.

(57) ABSTRACT

An apparatus for inflating film for manufacturing packaging material in situ, wherein the apparatus comprises an inflating unit, a film conveying provision, a sealing unit and a film receiving means for receiving a film roll, wherein the apparatus is a compact apparatus with a relatively small footprint and wherein the inflating unit, film conveying provision and the sealing unit are provided in a central unit on the apparatus and are operatively positioned with respect to a center of the film to be inflated and sealed viewed in a direction at right angles to a film conveying direction, wherein the film to be inflated is operatively engaged only in or near the center thereof by the central unit, for inflating the film from or from near the center, then sealing the film tight and conveying it, as well as a method for manufacturing packaging material.

20 Claims, 13 Drawing Sheets

U.S. PATENT DOCUMENTS

| | | | | |
|---|---|---|---|---|
| 7,490,449 | B1 * | 2/2009 | Eibert | 53/79 |
| 7,497,066 | B2 * | 3/2009 | Calogero | 53/403 |
| 7,503,156 | B2 * | 3/2009 | Eibert | 53/403 |
| 2002/0108352 | A1 * | 8/2002 | Sperry et al. | 53/403 |
| 2006/0090421 | A1 * | 5/2006 | Sperry et al. | 53/403 |
| 2006/0174589 | A1 * | 8/2006 | O'Dowd | 53/79 |

FOREIGN PATENT DOCUMENTS

| | | |
|---|---|---|
| WO | WO 00/53501 A | 9/2000 |

* cited by examiner

APPARATUS FOR INFLATING TUBE FILM FOR MANUFACTURING PACKAGING MATERIAL, AND A METHOD FOR INFLATING TUBE FILM WITH SUCH APPARATUS

FIELD OF THE INVENTION

The invention relates to an apparatus for inflating film for manufacturing packaging material in situ, wherein the apparatus comprises an inflating unit, a film conveying provision, a sealing unit and a film receiving means for receiving a film roll.

BACKGROUND

Such an apparatus is for instance known from NL1026527 of applicant. In the known apparatus, a tube film is inflated with the aid of an inflating unit, which provides the film with air via an air channel provided on one outer side of the film. On the same side of the film, a film conveying provision is provided on the apparatus for conveying the tube film and a sealing unit for sealing the inflated film tight. The tube film to be inflated is pretreated and comprises transversal seals and optionally transversal perforations for being able to tear off strings of air cushions. In use, the film is opened on the inflating side with the aid of a cutting element, and then air is blown therein and then the film is sealed tight again. A drawback of such an apparatus is that a film with a limited width can be processed thereon. Due to the fact that a certain minimum throughput rate is desired and a particular amount of air is needed for inflating the film, the width of the film is limited. When, in such an apparatus, the blow nozzle would be designed to blow in a larger amount of air per time unit, the air supply channel in the film should be wider. However, a wider air supply channel is undesired since it results in a larger edge of unused film on the inflated film. This is undesired for efficiency reasons. Therefore the known apparatus is not suitable for processing wide films for manufacturing mattress-like cushions, which are for instance used as exterior packaging for products in order to stabilize them in a further packaging and to protect them during transport.

SUMMARY OF THE INVENTION

Therefore, it is an object of the disclosed apparatus and method to provide an improved apparatus for inflating film. More particularly, the disclosed apparatus and method contemplate providing an apparatus which is suitable for processing film of various widths, wherein this film can be filled at a relatively high processing speed, wherein different sizes of film can be used randomly, wherein the number of adjustment to the apparatus is minimal when changing from one size of film to another size of film.

The invention therefore provides an apparatus according to the type mentioned in the introduction, characterized in that the apparatus is a compact apparatus with a relatively small footprint and wherein the inflating unit, film conveying provision and the sealing unit are provided in a central unit on the apparatus and are operatively positioned with respect to a center of the film to be inflated and sealed viewed in a direction at right angles to a film conveying provision, wherein the film to be inflated is operatively engaged only in or near the center thereof by the central unit, for inflating the film from or from near the center, and then sealing it tight and conveying it. With such an apparatus, where the film is only engaged at or near a center thereof and wherein, on both sides, the film is not bounded by parts of the apparatus, films of various widths can be processed. For this, the apparatus does not need to be set in a different manner. For instance, films with a width of 80-100 cm can be filled and sealed without any problems. Such an apparatus has a double capacity compared to the above-mentioned apparatus according to the prior art. This makes it possible that, on a packaging location, it is sufficient to put the apparatus into action, so that sufficient packaging material can be manufactured per time unit for continuously packaging articles. This makes bins for receiving already manufactured packaging material superfluous, which saves space.

According to a further elaboration of the invention, the central unit comprises a first part and an opposite second part, wherein each part is arranged to operatively engage a respective side of the film. In a further elaboration of the invention, at least one part of the central unit, preferably the second part, is removable to enable introducing the film roll into the apparatus or to remove it. Such a configuration of the apparatus facilitates placing and removing a film roll and, also, feeding the film through the central unit is simple. This makes it possible to realize changing the film roll in a short period of time, and no special knowledge of the apparatus is necessary. This promotes the simple operation and use of the apparatus, which is favorable for the speed of packaging products with the aid of the manufactured packaging material.

According to a further embodiment of the invention, the footprint of the apparatus has a size of less than 0.5 $m^2$, more in particular of less than 0.2 $m^2$, preferably of substantially 0.18 $m^2$. The footprint may, for instance, have dimensions of 600×300 mm.

Such a compact apparatus has a small footprint and has a relatively low weight. This makes the apparatus easy to move and to use on various locations.

In a further elaboration of the invention, the film receiving means is provided with at least one supporting element, while the film receiving means operatively at least partly bounds the film roll preferably on a bottom side only. Such a film receiving means is easy to use. The film roll only needs to be placed on the film receiving means. Further, such a film receiving means does not impose restrictions on the width of the film to be used. If desired, adjustable bearings may be provided on the film receiving means on both sides of the film roll, so that the film roll can be fixed in lateral direction with respect to the blow nozzle of the apparatus. According to a further elaboration of the invention, it is also possible to drive the film receiving means so that the film roll is actively unrolled. For this, for instance at least one supporting element can be driven. This is, for instance, favorable when the film roll has a relatively large diameter and is consequently relatively heavy.

According to a further elaboration of the invention, the inflating unit has a blow nozzle which comprises a rounded top at a blow nozzle end, and wherein the top is provided with an inside which gradually changes from a direction opposite to the film conveying direction to a transverse direction extending substantially transversely to the film conveying direction. The blow nozzle has at least two air outlet openings which are placed at an angle with respect to the film conveying direction. Such a nozzle provides an air flow of which a forward direction gradually changes to two lateral directions, due to the rounded top. Air thus flows in a regular manner to the sides of the film and to the back side on both sides of the film in a same plane as the film. The space to be filled which is in open connection with a center of the film is filled more easily and more uniformly by the blow nozzle. Preferably, according to a further elaboration of the invention, the angle between the at least one air outlet opening and the film conveying direction has a magnitude of 15-50°, more in particular of about 20-30° and preferably of substantially 23°. As a result, the air is blown into the film in such a manner that the film layers first come apart and the film is then inflated to be full from a center. This is particularly favorable in solving a common problem, namely, when the film layers on the film roll are very firmly stuck to each other, do stick to one another, substantially at the end of the film on the film roll and more in particular with thick film rolls comprising a large length of film.

According to a further elaboration of the invention, the apparatus is arranged to process film with a film thickness of substantially 10 μm-150 μm. For this, it is particularly favorable that, according to a further elaboration of the invention, the apparatus comprises a control for independently controlling the film conveying provision, the inflating unit and/or the sealing unit. Because the control can control the film conveying provision, the inflating unit and the sealing unit, the throughput rate can be varied, and accordingly the unrolling velocity of the film, the velocity of supplying air through the blow nozzle and the temperature of the sealing unit, as well as switching the different parts to be controlled on and off. When a very thin film is processed, the settings of the different parts will need to be adjusted so that the film does not become creased and does melt through completely. By controlling the inflating unit, a wider film can also be filled in a same time unit as a narrower film. It is clear that many different types and sizes of films can be processed to packaging material on the apparatus.

In a further elaboration of the invention, the film to be processed on the apparatus is a tube film, provided with a pattern of seals, for instance straight or undulating transversal seals with an interruption in a center thereof or point seals in a pattern over a whole width of the tube film. The use of a pretreated tube film on the apparatus makes the eventually manufactured packaging material relatively inexpensive. This is because a tube film is less expensive than manufacturing a film from two film layers which are attached to each other by means of a stamp and where the stamp at the same time presses a pattern into the film.

According to a further elaboration of the invention, the first part of the central unit is built up from a first set of parts, wherein the first set of parts comprises at least one sealing block of the sealing unit, which is provided with a sealing thread extending in film conveying direction and at least one driven roller of the film conveying provision, wherein a first conveyor belt is guided over the sealing block and the driven roller, wherein the second part of the central unit is built up from a second set of parts, wherein the second set of parts comprises at least one pressing block set up opposite the sealing block and a return pulley, over which a second conveyor belt is guided, wherein the film is operatively clamped between the conveyor belts and is pulled forward by these conveyor belts in the film conveying direction. Such a configuration of the central unit brings about an efficient system for conveying, inflating and sealing the film. The film cannot run off the central unit and because the conveyor belts clamp the film and only one of the conveyor belts is driven, the film is prevented from becoming creased or even tearing.

In a further elaboration of the invention, both the first set of parts of the first part of the central unit and the second set of parts of the second part of the central unit are provided twice, wherein the first sets and the second sets are substantially parallel next to each other viewed in the film conveying direction, wherein the blow nozzle is provided at least partly between the first sets and/or the second sets. Such a central unit blows the whole film full of air from the center, after which the film is sealed tight at two places at once by the two sealing threads on the two sealing blocks. When only one sealing thread is heated, for instance by controlling the control, on an apparatus according to the invention, it is also possible to process a single film as described in the prior art.

Further, according to a further elaboration of the invention, the apparatus may further comprise at least one cutting element for cutting at least one film layer of the film.

According to a further elaboration of the invention, the at least one cutting element is provided on the blow nozzle upstream of the air outlet openings, wherein blade of the cutting element extends from the blow nozzle between the sealing blocks and/or the pressing blocks. In an alternative embodiment of the invention, the at least one cutting element may also be provided on the apparatus, wherein a blade of the cutting element extends from the apparatus to the blow nozzle. Such a cutting element cuts loose at least one film layer of the inflated film, so that the blow nozzle is clear and the film can be moved in the film conveying direction. When the apparatus is provided with two cutting elements, both film layers of the film can be cut if desired, so that, for instance, two separate strings of bags can be obtained. This is particularly favorable when the apparatus is, for instance, positioned between two packaging locations. Preferably, according to a favorable embodiment of the invention, the at least one cutting element is removable from the blow nozzle or the apparatus, by for instance folding or detaching. As a result, a cutting element can simply be used, removed or an additional cutting element can be positioned.

The invention further relates to a method for manufacturing packaging material from a film, wherein the method comprises:

providing an above-described apparatus;

opening the central unit;

placing a film roll on the film receiving means of the apparatus;

introducing the film into the central unit, wherein the blow nozzle of the inflating unit is introduced into a side of the film remote from the film roll in a direction opposite to the film conveying direction;

closing the central unit;

controlling the central unit for inflating the film from or from near the center of the film, then sealing the film tight and conveying the film through the apparatus. Such a method has the same advantages and effects as those mentioned for the above-described apparatus for manufacturing packaging material in situ.

BRIEF DESCRIPTION OF THE DRAWINGS

Further elaborations of the invention are described in the claims and will hereinafter be explained in more detail, with reference to the drawings, in which:

DETAILED DESCRIPTION OF THE DRAWINGS

Figure 1A:
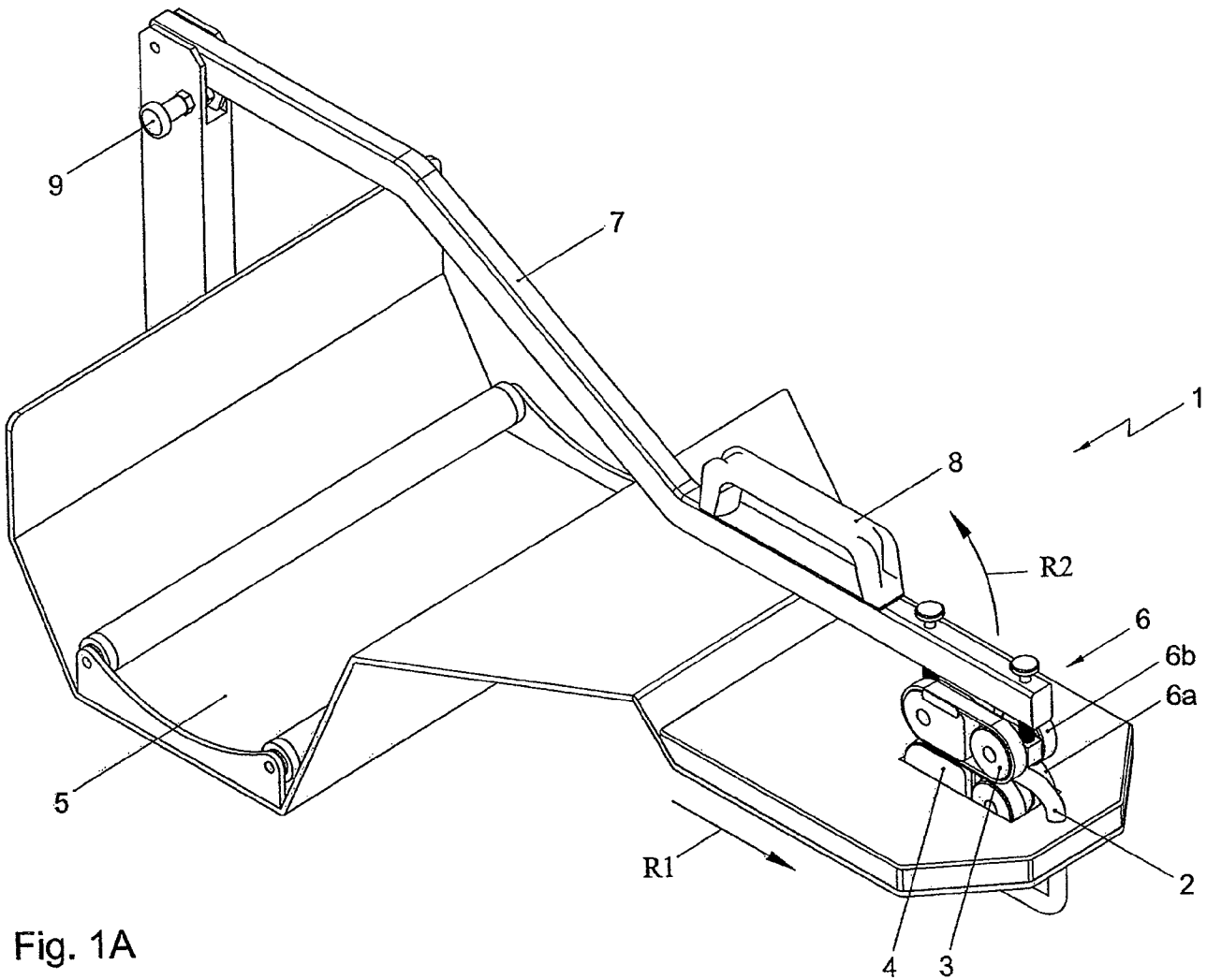
FIG. 1*a* shows a schematic perspective view of the apparatus according to the invention.
Figure 1B:
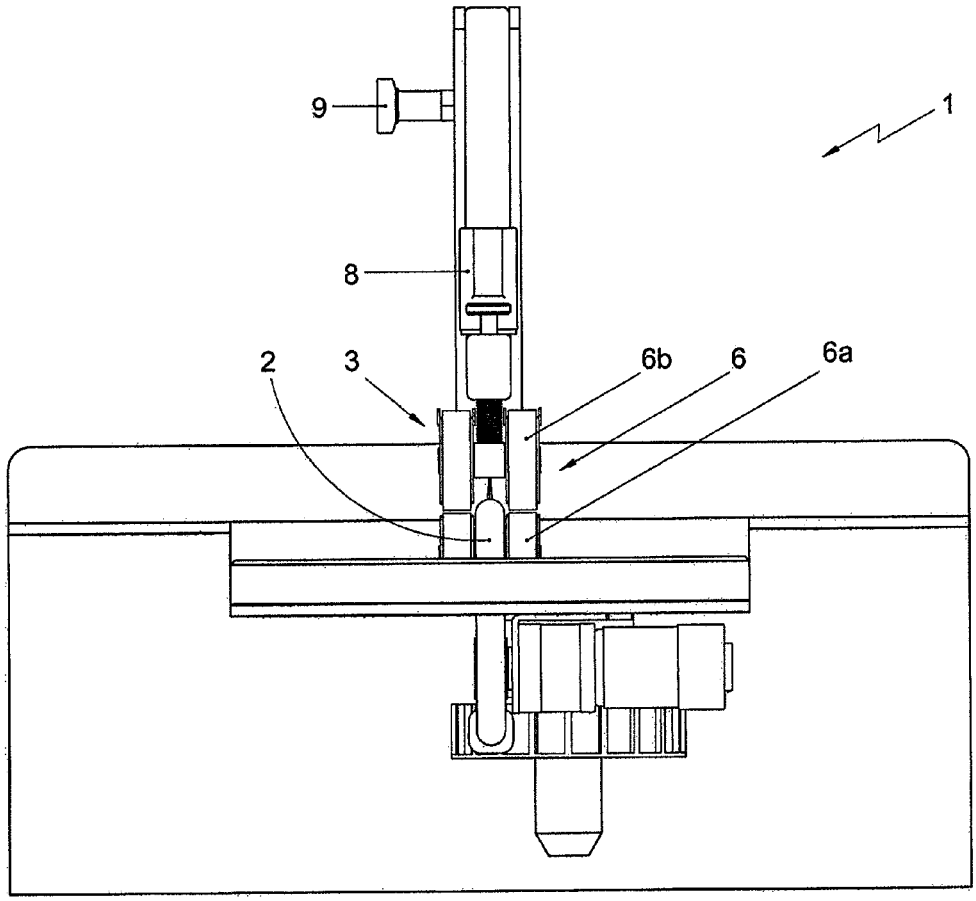
FIG. 1*b* shows a schematic front view of the apparatus of FIG. 1*a;*
Figure 1C:
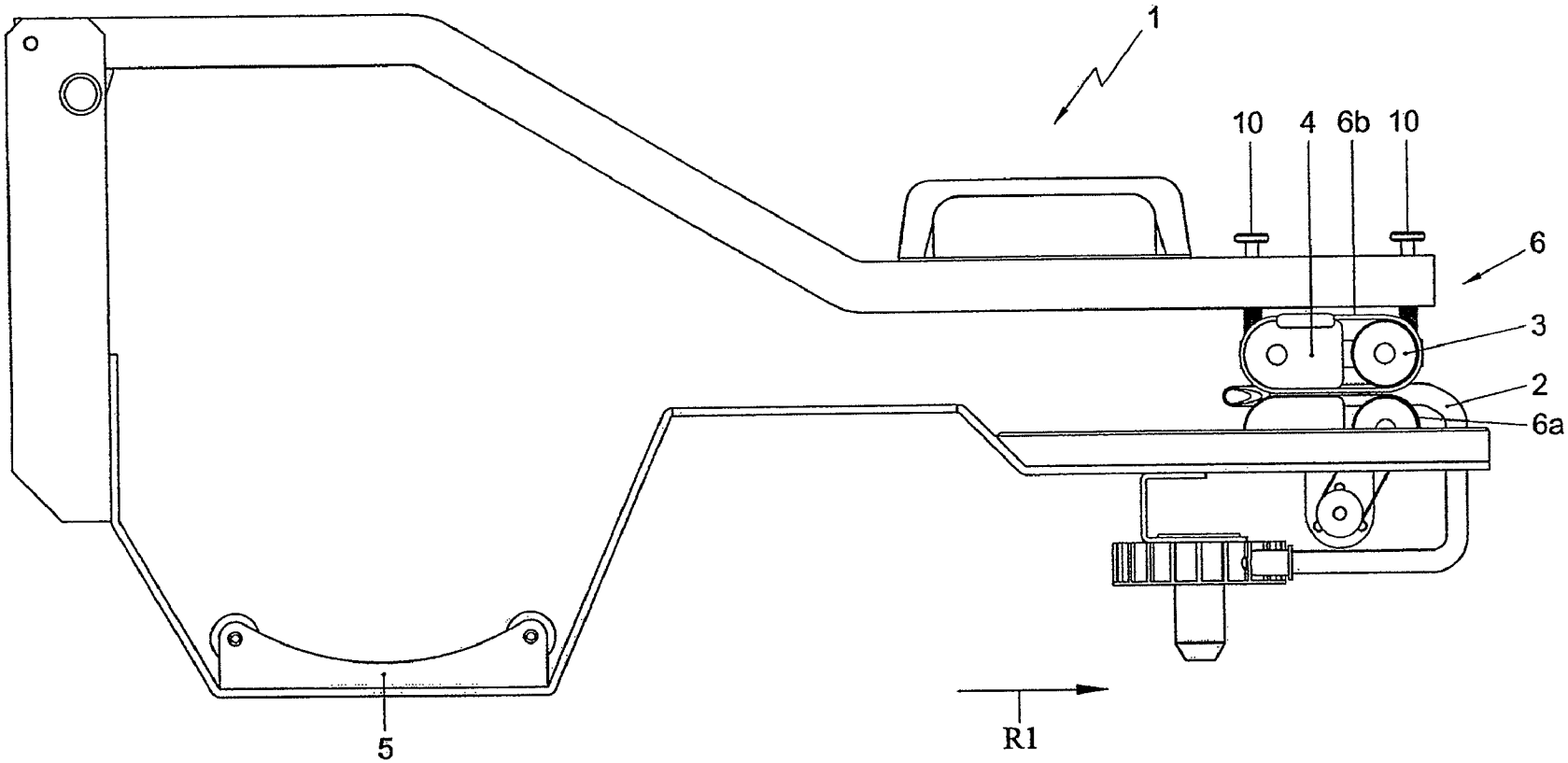
FIG. 1*c* shows a schematic side elevational view of the apparatus of FIG. 1*a;*
Figure 1D:
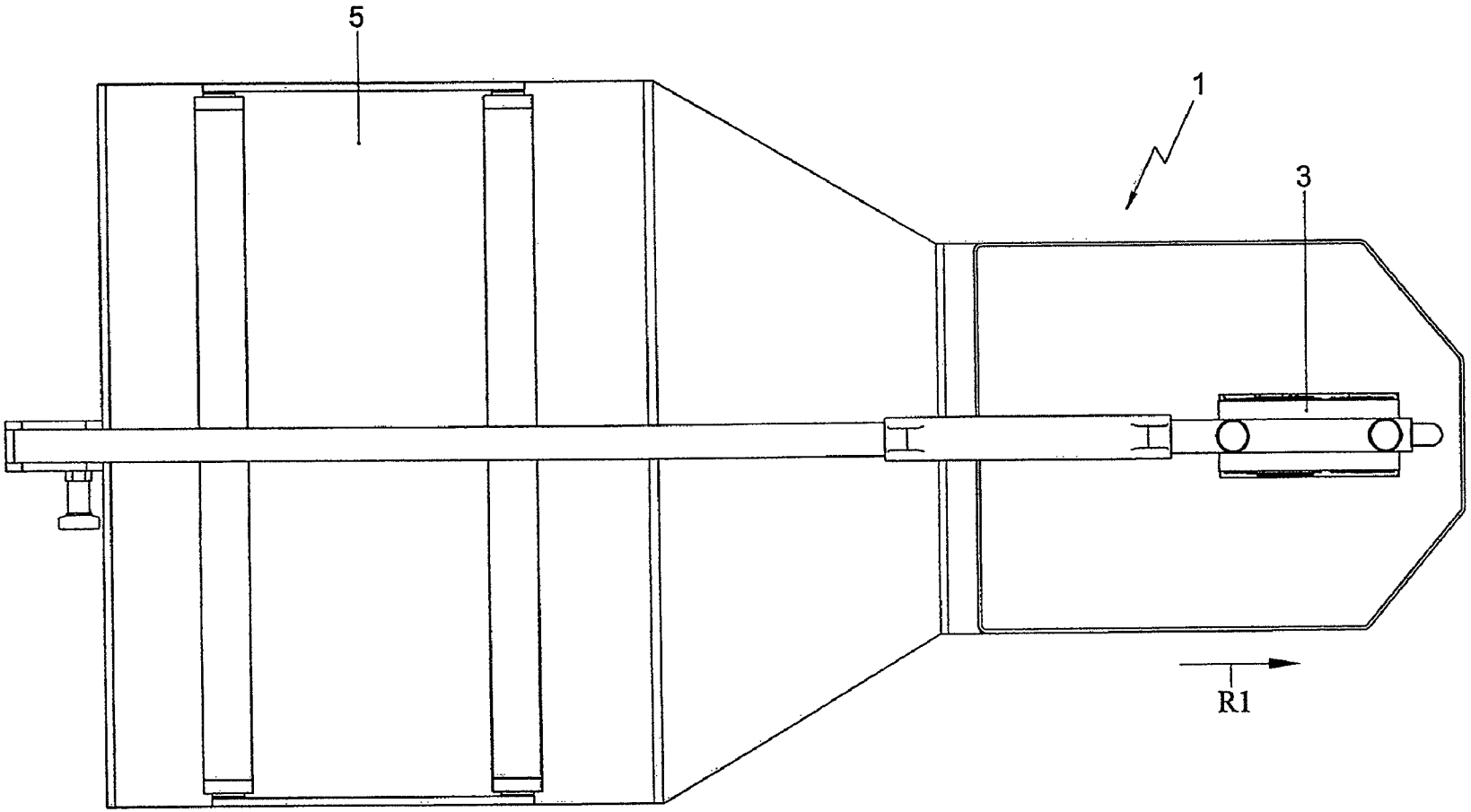
FIG. 1*d* shows a schematic top plan view of the apparatus of FIG. 1*a*

It is noted that same parts are designated by same reference numerals in the different Figures.

In FIGS. 1*a*-1*d*, different views of an apparatus 1 for inflating film for manufacturing packaging material in situ is shown. The apparatus 1 comprises an inflating unit 2, a film conveying provision 3, a sealing unit 4 and a film receiving means 5. The apparatus 1 is a compact apparatus with a relatively small footprint. The apparatus 1 has a central unit 6 which comprises the inflating unit 2, the film conveying provision 3 and the sealing unit 4. In use, the central unit 6 is positioned with respect to a center (not shown) of the film in a direction at right angles to the film conveying direction R1. The film is engaged by the central unit 6 only in a center of the film, after which the film is inflated from the center, sealed tight and conveyed. This is further explained in FIGS. 6*a*-6*c*.

The central unit 6 has a first part 6*a* and an opposite second part 6*b*. The second part 6*b* is removable so that a film roll can be easily introduced into the apparatus 1 or removed. The second part 6*b* of the central unit 6 is attached to a lever 7. The lever 7 is hingedly provided on the apparatus 1 and locked by a lock 9. By releasing the lock 9, the lever 7 can be moved away from the apparatus 1 in a direction R2 with the aid of handle 8. A film roll can then be placed on the film receiving means 5. The film receiving means 5 surrounds the film roll, at least partly, on a bottom side only and comprises two supporting elements 11 (see, FIG. 2A). In this embodiment of the invention, the supporting elements 11 are not driven. After placing the film roll on the film receiving means 5, the lever 7 can be moved in a direction opposite to direction R2 until lock 9 comes into the locking position again and the lever 7 is fixed. By fixing the lever 7, it is at the same time realized that the second part 6*b* of the central unit 6 is placed on the first part 6*a* of the central unit 6 with exactly the right pressure. A spring system 10 provided in the second part 6*b* of the central unit 6 provides the desired pressure. The spring system 10 can be set when the film thickness of the film to be processed is varied, for instance a film thickness of substantially between 10 μm-150 μm.

Figure 2A:
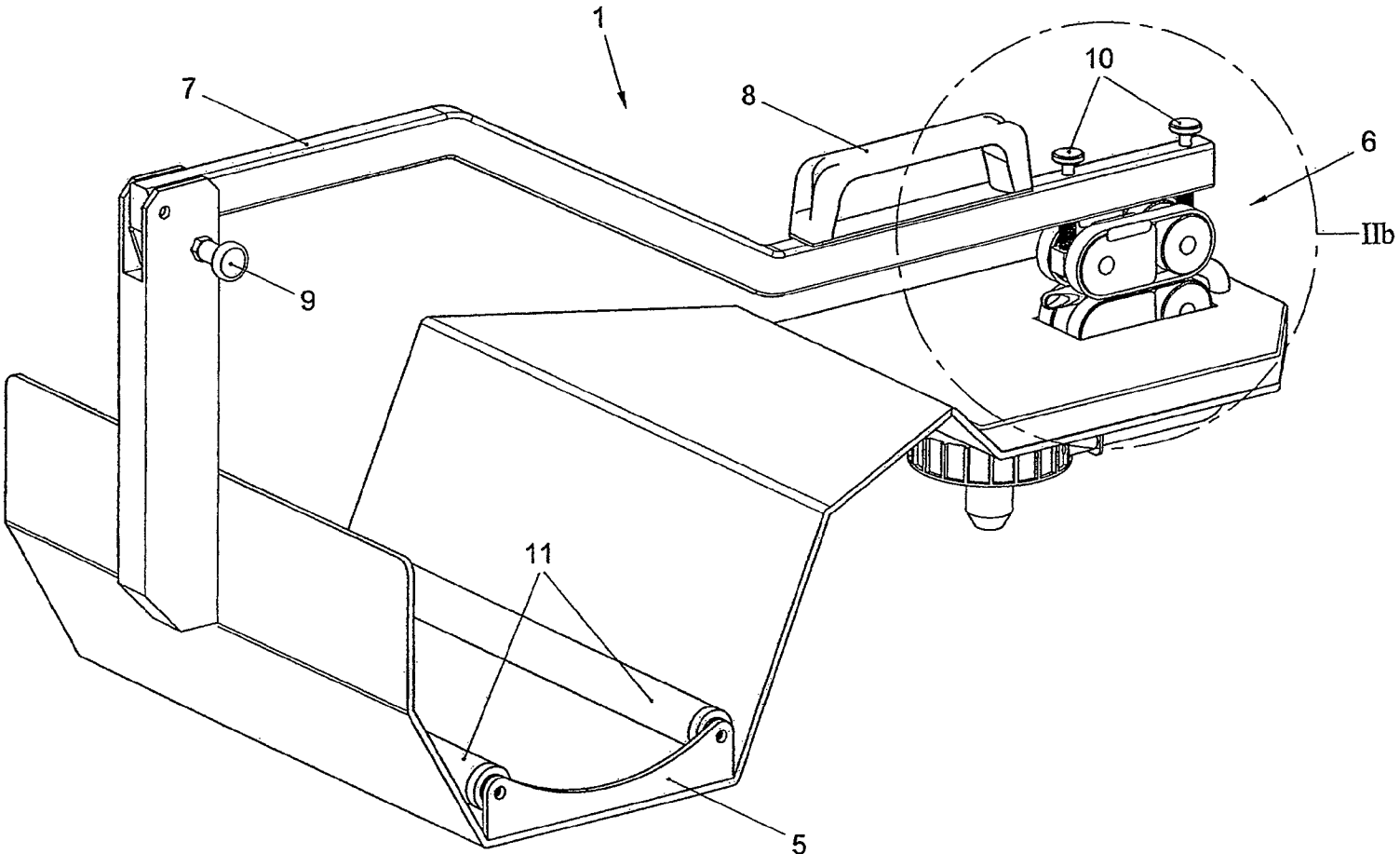
FIG. 2*a* shows a further schematic perspective view of the apparatus according to the invention.
Figure 2B:
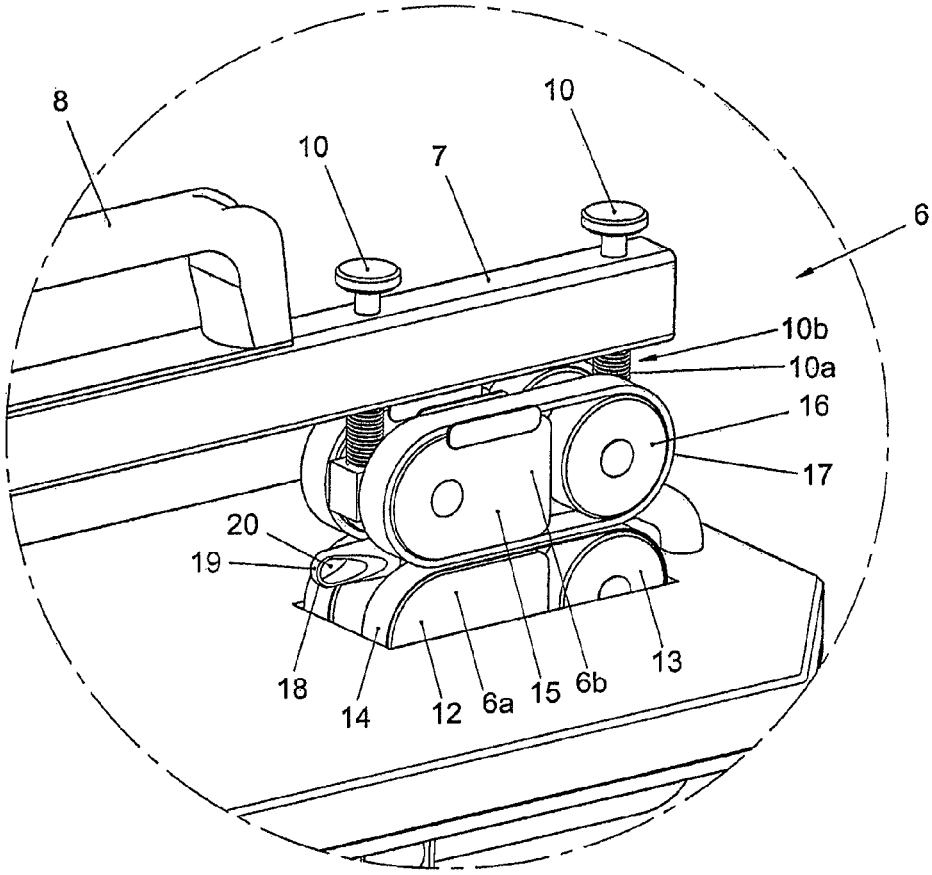
FIG. 2*b* shows a perspective view of a detail of the apparatus of FIG. 2*a;*

With reference to FIGS. 2*a* and 2*b*, the central unit 6 will be described in more detail. The first part 6*a* of the central unit 6 is built up from a first set of parts. The set of parts comprises a sealing block 12, which is provided with a sealing thread extending in the film conveying direction R1 (not shown). The set of parts further comprises a driven roller 13 and a first conveyor belt 14 which is guided over the sealing block 12 and the driven roller 13. The first conveyor belt 14 is a Teflon belt. The second part 6*b* of the central unit 6 is built up from a second set of parts. The second set of parts comprises a pressing block 15 set up opposite the sealing block 12 and a return pulley 16, over which a second conveyor belt 17 is guided. In this exemplary embodiment of the invention, the second conveyor belt 17 is an oppositely circulating belt of silicones. The film to be inflated is operatively clamped between the two conveyor belts 14, 17 and is pulled forward by the conveyor belts 14, 17 in the film conveying direction R1. In FIG. 2*b*, it can clearly be seen that, in this exemplary embodiment of the invention, both the first set of parts of the first part 6*a* of the central unit 6 and the second set of parts of the second part 6*b* of the central unit are provided twice. The first sets and second sets are substantially parallel next to each other viewed in film conveying direction R1. Further, it can clearly be seen in FIG. 2*b* that the inflating unit 2 provided in the central unit 6 is provided at least partly between the first sets and the second sets and has a blow nozzle 18 with a top 19 at the blow nozzle end 18*a* (see, FIG. 5), which top is rounded, at least provided with a blunt front side, and two air inlet openings 20 upstream thereof. The blow nozzle 18 is discussed in more detail in the description of FIG. 5. A downstream inside of the top 19 gradually merges into upstream longitudinal sides of the blow nozzle. In other words, at a blow nozzle end, the blow nozzle is provided with an inside which gradually changes from a direction opposite to the film conveying direction to a transverse direction extending substantially transversely to the film conveying direction.

In FIG. 2*b*, it can further be seen clearly that the spring system 10 comprises two parts, namely a spring pin 10*a* and a spring 10*b* provided around the spring pin 10*a*. The strength of such a spring system 10 can be preset, but the setting may be changed, for instance, depending on the film thickness of a film to be processed.

Figure 3A:
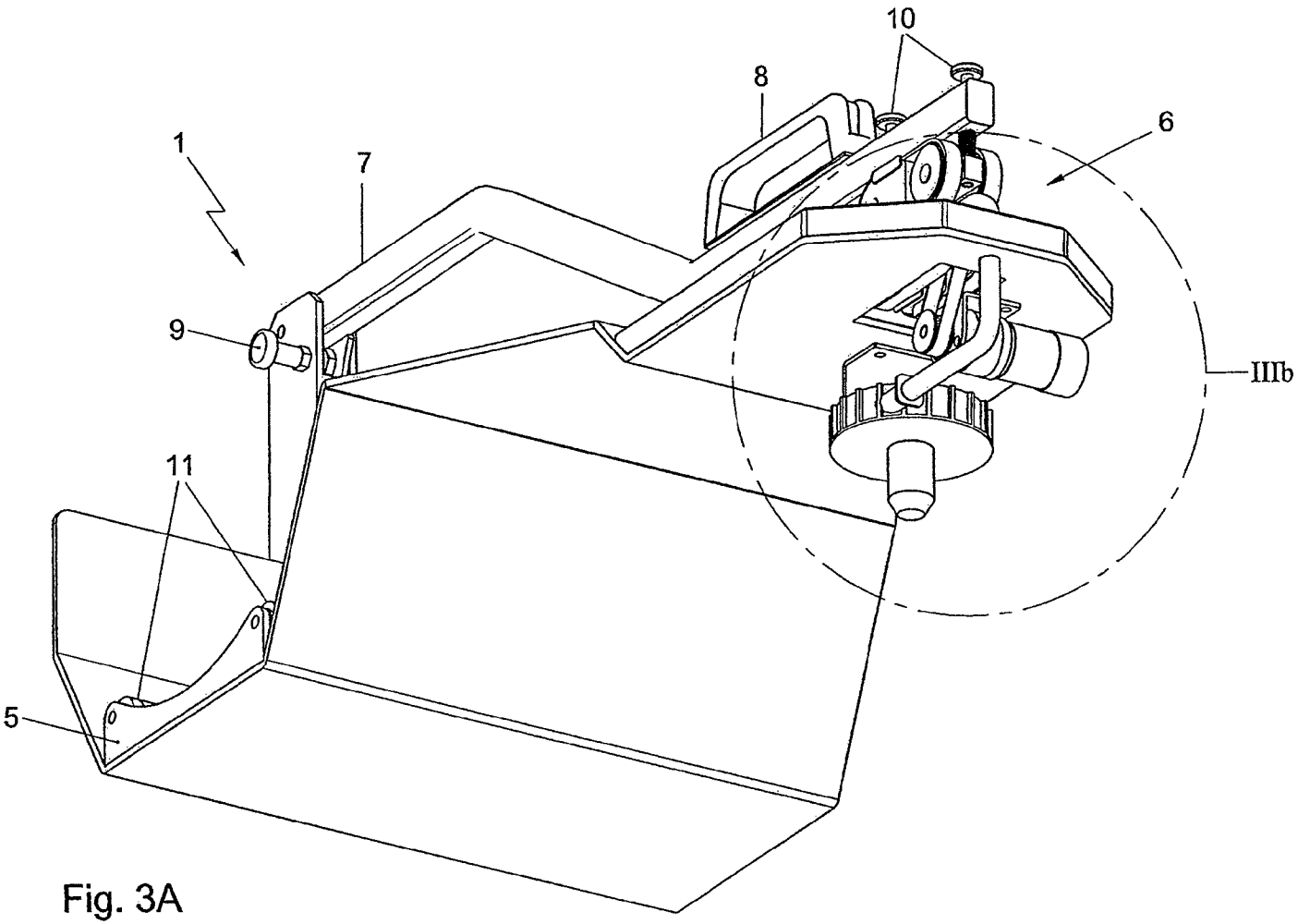
FIG. 3*a* shows a further schematic perspective view of the apparatus according to the invention.
Figure 3B:
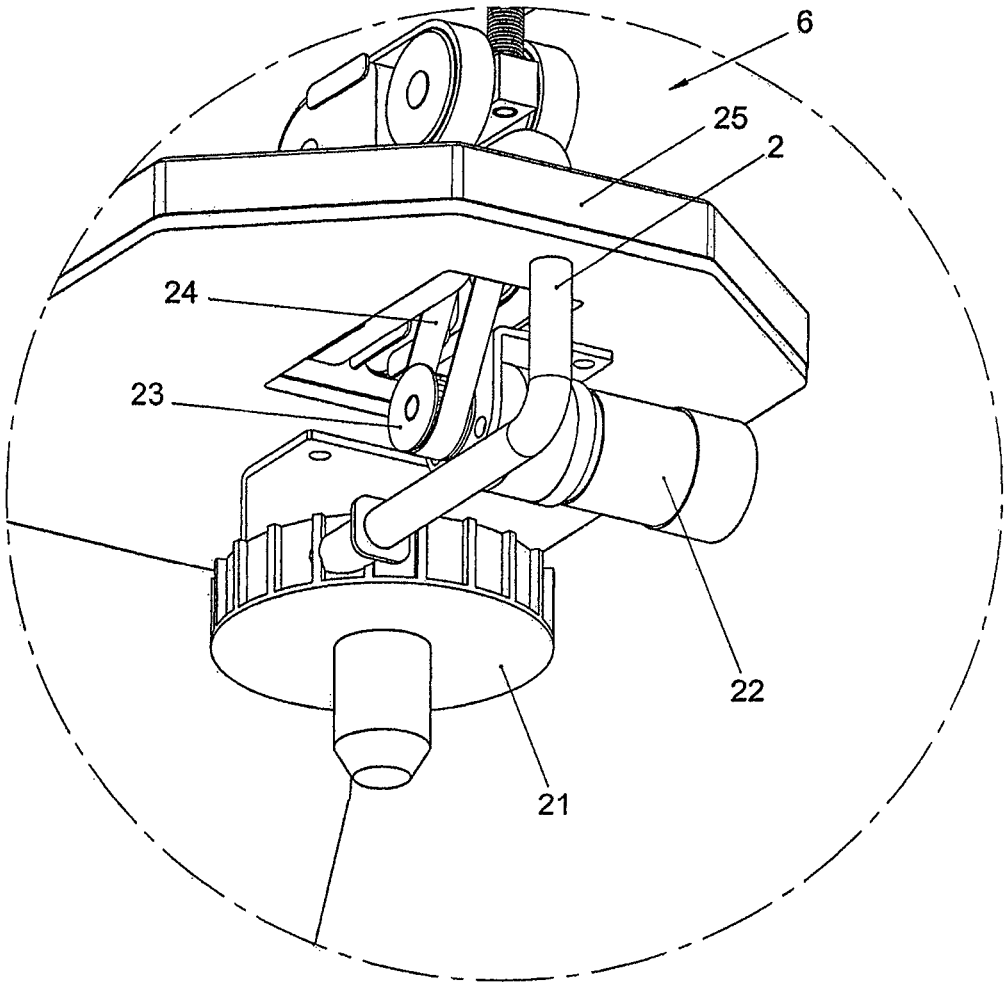
FIG. 3*b* shows a perspective view of a detail of the apparatus of FIG. 3*a;*

The inflating device 2 is clearly shown in FIGS. 3*a* and 3*b*. The blow nozzle 18 is in fluid connection with a fan 21 for generating an air flow which ends up in the film to be inflated through the air outlet openings 20 of the blow nozzle 18. The fan 21 is provided under a base plate 25 of the apparatus 1 and attached to the base plate 25. Of course, it is readily apparent to a skilled person that this may also be constructed in a different manner. In addition, on a bottom side of the base plate 25, a motor 22 is provided which drives the driven rollers 13 of the film conveying provision 3 via a transmission 23, 24.

Figure 4A:
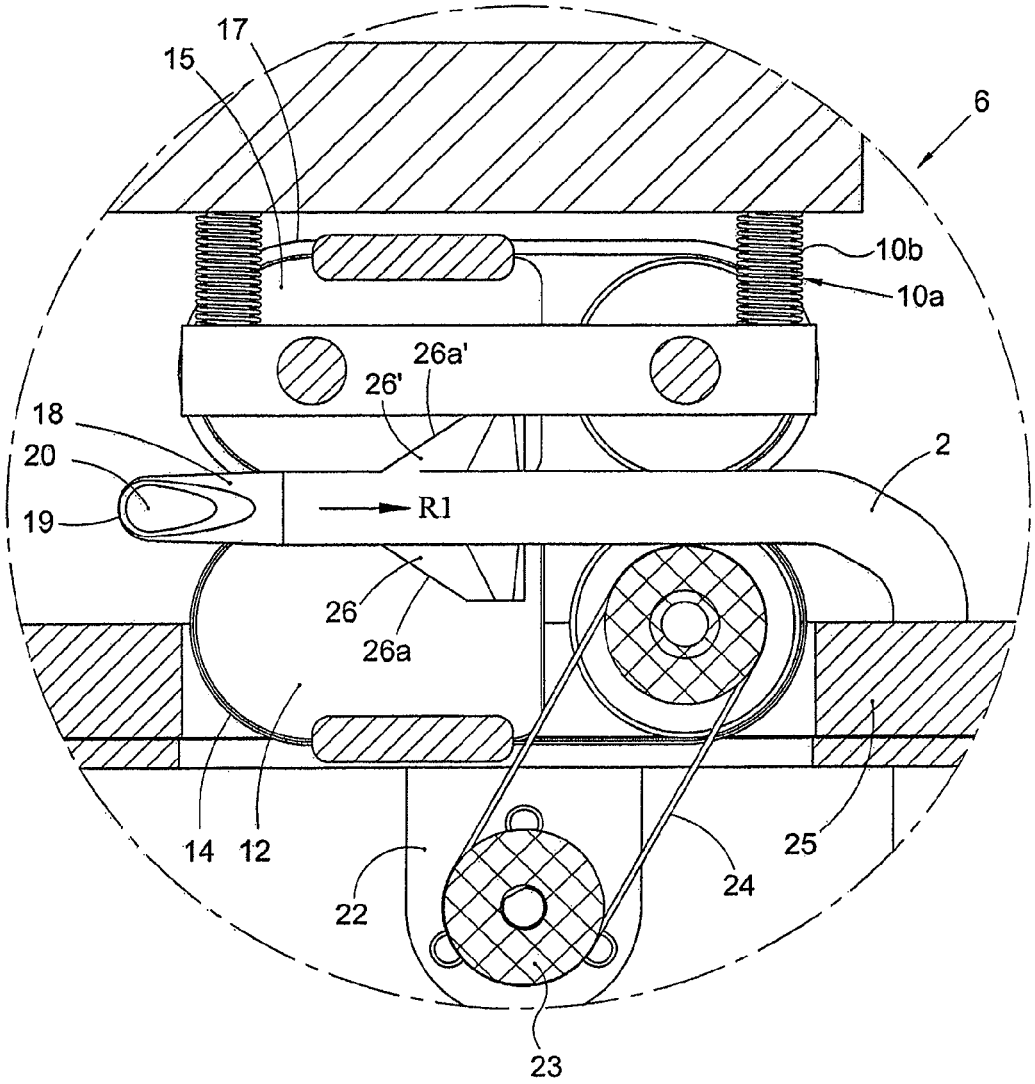
FIG. 4*a* shows a schematic cross-sectional view of the central unit of the apparatus according to the invention.
Figure 4B:
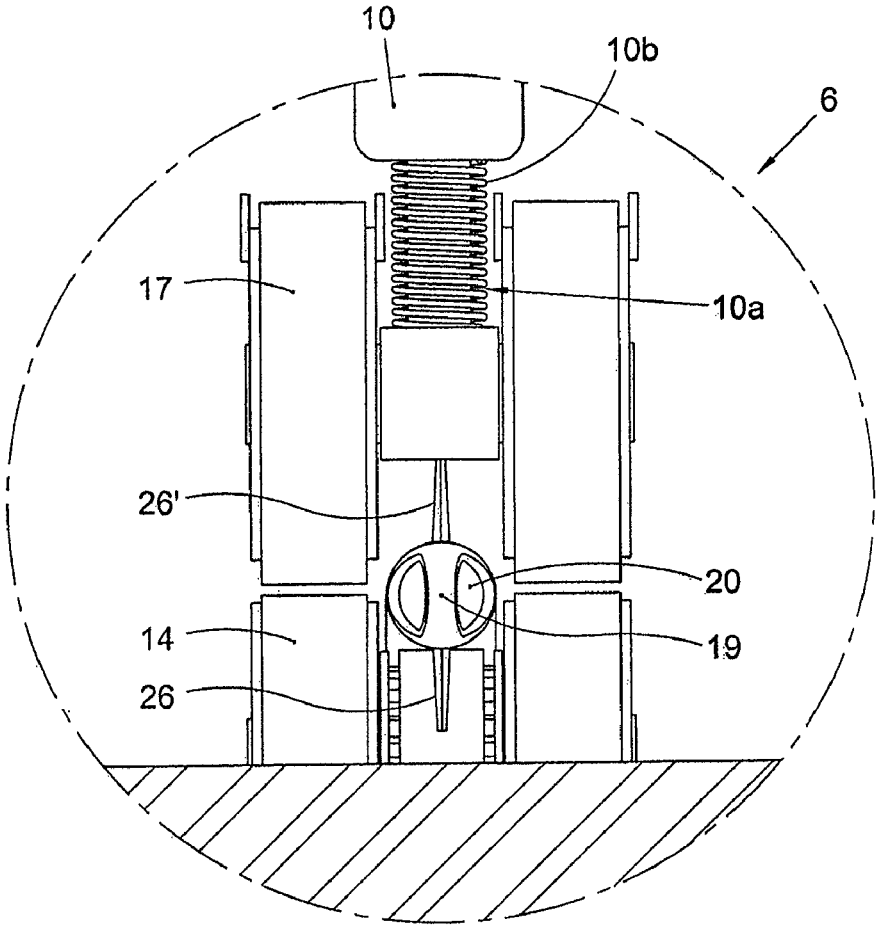
FIG. 4*b* shows a further schematic cross-sectional view of the central unit of the apparatus according to the invention.

In FIGS. 4*a* and 4*b*, two schematic cross-sectional views are shown of the central unit 6 according to the invention. The transmission 23, 24 from the motor 22 to the driven roller 13 of the film conveying unit 3 is clearly shown. It can further be seen that the apparatus 1 is provided with two cutting elements 26, 26' which are removable, in this exemplary embodiment of the invention by detaching at least one of the two cutting elements 26, 26'. In another embodiment, the cutting elements 26, 26' may also be provided on the apparatus 1 so as to be foldable. The lower cutting element 26 is provided on the apparatus 1 to cut the lower film layer of the film to be inflated after it has been inflated with the aid of the inflating unit 2. This is because the film is operatively moved in the film conveying direction R1 while the blow nozzle 18 slides further into the film. To allow the film to move beyond the blow nozzle 18, the lower cutting element 26 cuts the film layer so that the film can pass the blow nozzle 18. The packaging material created from the inflated film then has the same width as the film supplied to the central unit 6. The inflated film, for instance in the form of a mattress, can be used for wrapping, for instance, fragile products for the protection thereof.

When, as shown in FIG. 4*a*, two cutting elements 26, 26' are provided, in use, both film layers of the inflated film are cut. In this case, two strings of inflated bags are obtained from film. The cutting elements 26, 26' are provided on the blow nozzle 18 upstream of the air outlet openings 20 of the blow nozzle 18. The blade 26*a* of the cutting element 26 extends from the blow nozzle 18 between the sealing blocks 12 and the blade 26*a'* extends from the blow nozzle 18 between the pressing blocks 15. In another embodiment, the cutting elements 26, 26' may also extend from the apparatus 1 in the direction of the blow nozzle 18.

Figure 5:
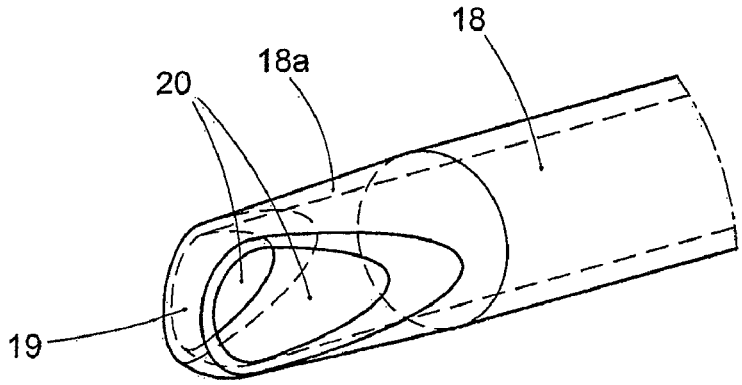
FIG. 5 shows a schematic perspective view of the blow nozzle of the apparatus according to the invention.
Figure 6A:
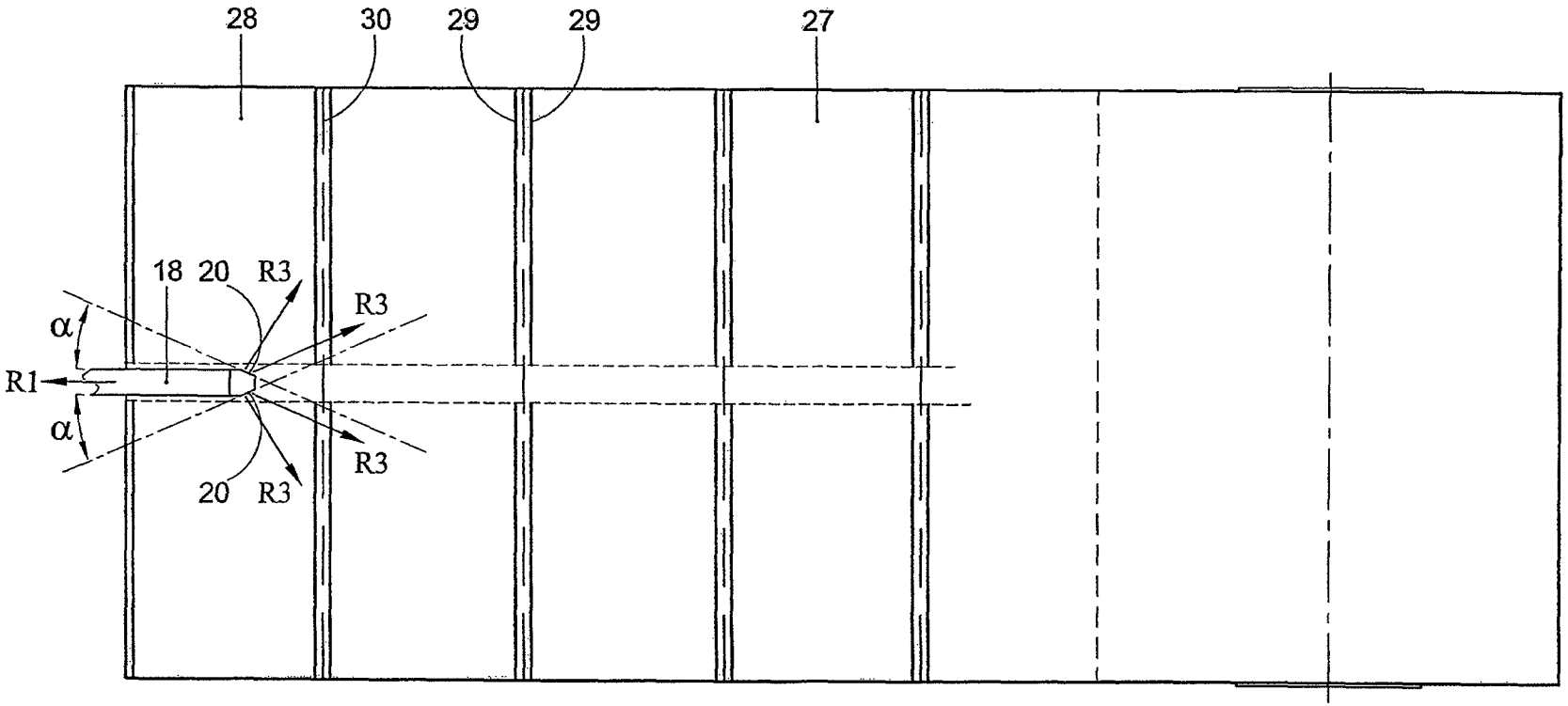
FIGS. 6*a-c* show views of a film roll for use in an apparatus according to the invention.
Figure 6B:
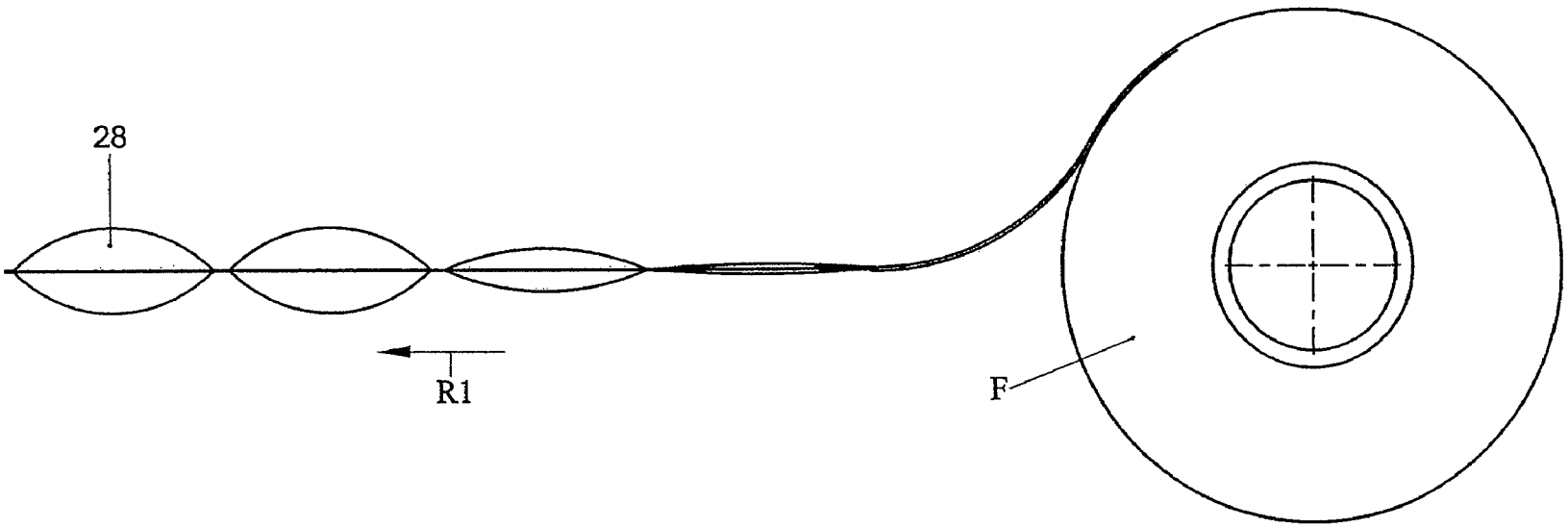
Figure 6C:
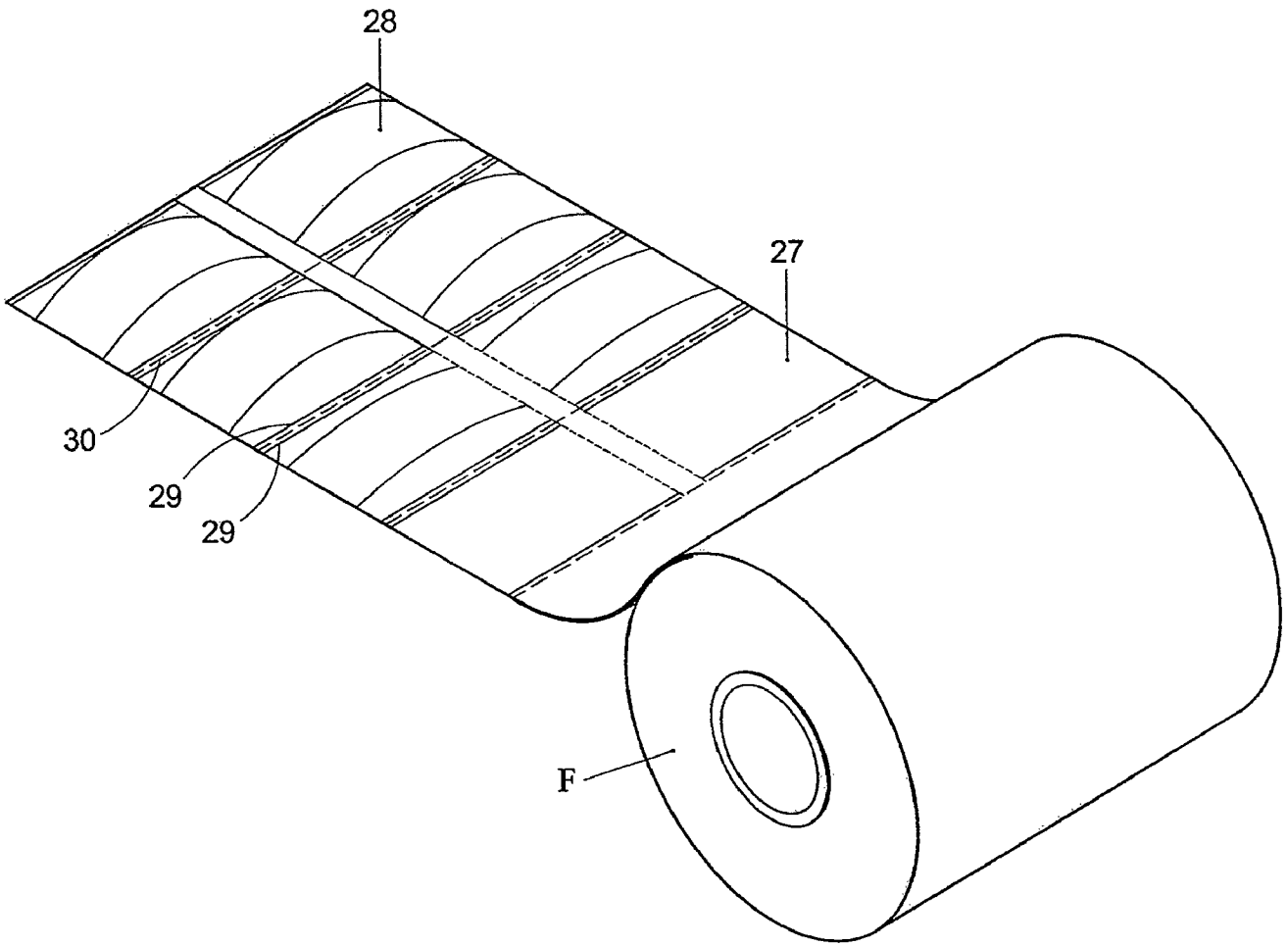

FIG. 5 shows a perspective view of the blow nozzle 18. The air outlet openings 20 are provided at a blow nozzle end 18*a* of the blow nozzle 18 and are at an angle α with respect to the film conveying direction R1. At least, each opening 20 extends along a virtual plane, which plane includes abovementioned angle α with direction R1. In FIG. 6*a*, in which a top plan view of a film 27 to be inflated is shown, the blow nozzle 18 is drawn in. Here, it can clearly be seen that the air outlet openings 20 are placed at an angle α. The angle α approximately has a magnitude of about 15-50°, more in particular of about 20-30°, and preferably of substantially 23°. The front side 19 of the blow nozzle blocks the air flow in a forward direction, at least in the direction opposite to the conveying direction R1.

The film 27 to be processed in the apparatus 1 is preferably a tube film 27, which is provided on a film roll F, which is placed on the film receiving means 5. In use, the film 27 moves with the aid of the film conveying provision (not shown in FIGS. 6*a*-6*c*) in the film conveying direction R1. At the same time, an air flow is blown through the blow nozzle 18 via the air outlet openings 20 in direction R3 into the film 27. Due to the rounded top 19 and the air outlet openings 20 placed at an angle α, the air flows into the film 27 in direction R3. As a result, the separate spaces 28, provided in the film 27 by means of transversal seals 29, are filled with the air. Then the film 27 is sealed by the sealing unit 4, so that longitudinal seals provided in the same direction as the film conveying direction R1 are formed. Between the transversal seals 29, a perforation edge 30 may be provided, so that an amount of filled separate spaces 28 can easily be torn off without damaging the rest of the film. In such a manner, a desired size of filled packaging material can be obtained. It is clear that the transversal seals may of course also have a different shape than a straight shape. Thus, the seals may have an undulating shape or may contain interruptions. This may, for instance, be a pattern of point seals provided over the whole width of the tube film. This could be desired when different mattress-shaped packaging materials are needed for packaging different products. The sealing unit 4, the film conveying provision 3 and the inflating unit 2 are connected to a control (not shown) which is arranged to control inter alia the temperature of the sealing thread, the conveying velocity, and the air flow velocity independently of one another. In such a manner, the individual parameters can be set optimally for a particular film width and film thickness. Further, it is easy to change the settings if a film roll with a particular film width and film thickness is replaced by a film roll with a different film width and film thickness. This brings about a simply operable, compact apparatus for manufacturing packaging material from inflated film in situ.

It will be clear that the invention is not limited to the exemplary embodiment described but that various modifications are possible within the framework of the invention, as defined by the claims. Thus, it is possible that only one set of a first and a corresponding second part of the central unit is in use. With such a control of only a part of the central unit, a single film provided with an air supply channel arranged on an outer side of the film may also be processed on the apparatus according to the invention. So, in such manner, a single longitudinal seal in a film conveying direction may also be manufactured on the single film. Then, it is not necessary to place two different apparatuses on a packaging location when both a single film and a double film need to be processed on a same packaging location.

The invention claimed is:

1. An apparatus for inflating film for manufacturing packaging material in situ, wherein the apparatus comprises: an inflating unit, a film conveying provision, a sealing unit and a film receiving means for receiving a film roll, wherein the apparatus is a compact apparatus, wherein the inflating unit, the film conveying provision and the sealing unit are provided in a central unit on the apparatus and are operatively positioned with respect to a center of the film to be inflated and sealed viewed in a direction at right angles to a film conveying direction, wherein the film to be inflated is operatively engaged only in or near the center thereof by the central unit, for inflating the film from or from near the center, then sealing the film and conveying it, wherein the inflating unit has a blow nozzle, which comprises a rounded top at a blow nozzle end, and a downstream inside of the rounded top gradually merges into upstream longitudinal sides of the blow nozzle, upstream and downstream referring to a normal air flow direction in the blow nozzle during use, wherein the blow nozzle has at least two air outlet openings that are placed at an angle with respect to the film conveying direction, such that, during use, air flows from each of said at least two air outlet openings in a regular manner into the film in a direction that lies in a same plane as the film, and that comprises a first component that is directed oppositely to the film conveying direction and a second component that is directed perpendicularly to the film conveying direction, and wherein the angle between the at least two air outlet openings and the film conveying direction has a magnitude of 15-50°.

2. The apparatus according to claim 1, wherein the central unit comprises a first part and an opposite second part, wherein each of the first part and the second part is arranged to operatively engage a respective side of the film.

3. The apparatus according to claim 2, wherein at least one of the first part and the second part of the central unit is removable to either introduce the film roll into the apparatus or remove the film roll.

4. The apparatus according to claim 2, wherein the first part of the central unit is built up from a first set of parts, wherein the first set of parts comprises at least one sealing block of the sealing unit, which is provided with a sealing thread extending in the film conveying direction and at least one driven roller of the film conveying provision, wherein a first conveyor belt is guided over the sealing block and the driven roller, wherein the second part of the central unit is built up from a second set of parts, wherein the second set of parts comprises at least one pressing block set up opposite the sealing block and a return pulley over which a second conveyor belt is guided, wherein, the film is operatively clamped between the first and second conveyor belts, and the film is pulled forward by the first and second conveyor belts in the film conveying direction.

5. The apparatus according to claim 4, wherein the first set of parts of the first part of the central unit and the second set of parts of the second part of the central unit are provided twice, wherein the first set of parts and the second set of parts are substantially parallel next to each other viewed in the film conveying direction, wherein the blow nozzle is provided at least partly between the first set of parts and/or the second set of parts.

6. The apparatus according to claim 3, wherein the footprint of the apparatus has a size of less than 0.5 square meters.

7. The apparatus according to claim 3, wherein the film receiving means includes at least one supporting element, wherein the film receiving means operatively at least partly bounds the film roll on a bottom side only.

8. The apparatus according to claim 3, wherein the apparatus is arranged to process film with a film thickness of substantially 10 μm-150 μm.

9. The apparatus according to claim 3, wherein the apparatus comprises a control for independently controlling the film conveying provision, the inflating unit or the sealing unit.

10. The apparatus according to claim 3, wherein the film to be inflated on the apparatus is a tube film having a pattern of seals, the pattern of seals being at least one pattern from the set of seal patterns including: straight or undulating transversal seals with an interruption in a center thereof, and point seals in a pattern over a whole width of the tube film.

11. The apparatus according to claim 3, wherein the apparatus further comprises at least one cutting element for cutting at least one film layer of the film.

12. The apparatus according to claim 11, wherein the at least one cutting element is provided on the blow nozzle upstream of the air outlet openings, wherein a blade of the cutting element extends from the blow nozzle between the sealing blocks or the pressing blocks.

13. The apparatus according to claim 11, wherein the at least one cutting element is provided on the apparatus, wherein a blade of the cutting element extends from the apparatus to the blow nozzle.

14. The apparatus according to claim 11, wherein the at least one cutting element is removable from the blow nozzle or the apparatus, by, for instance, folding or detaching.

15. A method for manufacturing packaging material from a film, wherein the method comprises:

providing the apparatus defined according to claim 1;

opening the central unit;

placing a film roll on the film receiving means of the apparatus;

introducing the film into the central unit, wherein the blow nozzle of the inflating unit is introduced into a side of the film remote from the film roll in a direction opposite to the film conveying direction;

closing the central unit;

controlling the central unit for inflating the film from or from near the center, then sealing the film and moving the film through the apparatus, and wherein one first and a corresponding second set of parts of the first part of the central unit and the second part of the central unit, respectively, are controlled for forming a single longitudinal seal in a film conveying direction on a single film provided with an air supply on an outer side thereof.

16. The method according to claim 15, wherein at least one cutting element is controlled for cutting at least one film layer of the film.

17. An apparatus for inflating film for manufacturing packaging material in situ, wherein the apparatus comprises: an inflating unit, a film conveying provision, a sealing unit and a film receiving means for receiving a film roll, wherein the apparatus is a compact apparatus, wherein the inflating unit, the film conveying provision and the sealing unit are provided in a central unit on the apparatus and are operatively positioned with respect to a center of the film to be inflated and sealed viewed in a direction at right angles to a film conveying direction, wherein the film to be inflated is operatively engaged only in or near the center thereof by the central unit, for inflating the film from or from near the center, then sealing the film and conveying it, wherein the inflating unit has a blow nozzle, which comprises a rounded top at a blow nozzle end, and a downstream inside of the rounded top gradually merges into upstream longitudinal sides of the blow nozzle, upstream and downstream referring to a normal air flow direction in the blow nozzle during use, wherein the blow nozzle has at least two air outlet openings that are placed at an angle with respect to the film conveying direction, such that, during use, air flows from each of said at least two air outlet openings in a regular manner into the film in a direction that lies in a same plane as the film, and that comprises a first component that is directed oppositely to the film conveying direction and a second component that is directed perpendicularly to the film conveying direction, wherein the central unit comprises a first part and an opposite second part, wherein each of the first part and the second part is arranged to operatively engage a respective side of the film, and wherein the first part of the central unit is built up from a first set of parts, wherein the first set of parts comprises at least one sealing block of the sealing unit, which is provided with a sealing thread extending in the film conveying direction and at least one driven roller of the film conveying provision, wherein a first conveyor belt is guided over the sealing block and the driven roller, wherein the second part of the central unit is built up from a second set of parts, wherein the second set of parts comprises at least one pressing block set up opposite the sealing block and a return pulley over which a second conveyor belt is guided, wherein, the film is operatively clamped between the first and second conveyor belts, and the film is pulled forward by the first and second conveyor belts in the film conveying direction.

18. The apparatus according to claim 17, wherein the first set of parts of the first part of the central unit and the second set of parts of the second part of the central unit are provided twice, wherein the first set of parts and the second set of parts are substantially parallel next to each other viewed in the film conveying direction, wherein the blow nozzle is provided at least partly between the first set of parts and/or the second set of parts.

19. An apparatus for inflating film for manufacturing packaging material in situ, wherein the apparatus comprises: an inflating unit, a film conveying provision, a sealing unit and a film receiving means for receiving a film roll, wherein the apparatus is a compact apparatus, wherein the inflating unit, the film conveying provision and the sealing unit are provided in a central unit on the apparatus and are operatively positioned with respect to a center of the film to be inflated and sealed viewed in a direction at right angles to a film conveying direction, wherein the film to be inflated is operatively engaged only in or near the center thereof by the central unit, for inflating the film from or from near the center, then sealing the film and conveying it, wherein the inflating unit has a blow nozzle, which comprises a rounded top at a blow nozzle end, and a downstream inside of the rounded top gradually merges into upstream longitudinal sides of the blow nozzle, upstream and downstream referring to a normal air flow direction in the blow nozzle during use, wherein the blow nozzle has at least two air outlet openings that are placed at an angle with respect to the film conveying direction, such that, during use, air flows from each of said at least two air outlet openings in a regular manner into the film in a direction that lies in a same plane as the film, and that comprises a first component that is directed oppositely to the film conveying direction and a second component that is directed perpendicularly to the film conveying direction, wherein the apparatus further comprises at least one cutting element for cutting at least one film layer of the film, and wherein the at least one cutting element is provided on the blow nozzle upstream of the air outlet openings, wherein a blade of the cutting element extends from the blow nozzle between the sealing blocks or the pressing blocks.

20. An apparatus for inflating film for manufacturing packaging material in situ, wherein the apparatus comprises: an inflating unit, a film conveying provision, a sealing unit and a film receiving means for receiving a film roll, wherein the apparatus is a compact apparatus, wherein the inflating unit, the film conveying provision and the sealing unit are provided in a central unit on the apparatus and are operatively positioned with respect to a center of the film to be inflated and sealed viewed in a direction at right angles to a film conveying direction, wherein the film to be inflated is operatively engaged only in or near the center thereof by the central unit, for inflating the film from or from near the center, then sealing the film and conveying it, wherein the inflating unit has a blow nozzle, which comprises a rounded top at a blow nozzle end, and a downstream inside of the rounded top gradually merges into upstream longitudinal sides of the blow nozzle, upstream and downstream referring to a normal air flow direction in the blow nozzle during use, wherein the blow nozzle has at least two air outlet openings that are placed at an angle with respect to the film conveying direction, such that, during use, air flows from each of said at least two air outlet openings in a regular manner into the film in a direction that lies in a same plane as the film, and that comprises a first component that is directed oppositely to the film conveying direction and a second component that is directed perpendicularly to the film conveying direction, wherein the apparatus further comprises at least one cutting element for cutting at least one film layer of the film, and wherein the at least one cutting element is provided on the apparatus, wherein a blade of the cutting element extends from the apparatus to the blow nozzle.

* * * * *